US005433310A

United States Patent [19]

Bell

[11] Patent Number: 5,433,310

[45] Date of Patent: Jul. 18, 1995

[54] COIN DISCRIMINATOR WITH OFFSET NULL COILS

[75] Inventor: Edward H. Bell, Chambersburg, Pa.

[73] Assignee: Coin Mechanisms, Inc., Glendale Heights, Ill.

[21] Appl. No.: 176,803

[22] Filed: Jan. 4, 1994

[51] Int. Cl.[6] ..... G07D 5/08

[52] U.S. Cl. ..... 194/318; 194/329

[58] Field of Search ..... 194/317, 318, 319, 328, 194/329, 330

[56] References Cited

U.S. PATENT DOCUMENTS

| | | | |
|---|---|---|---|
| 3,599,771 | 8/1971 | Hinterstocker | 194/318 |
| 3,870,137 | 3/1975 | Fougere | 194/100 A |
| 3,978,962 | 9/1976 | Gregory, Jr. | 194/328 |
| 4,327,824 | 5/1982 | Nicholson | 194/9 R |
| 4,460,080 | 7/1984 | Howard | 194/100 A |
| 4,469,213 | 9/1984 | Nicholson et al. | 194/100 A |
| 4,574,936 | 3/1986 | Klinger | 194/318 |
| 4,664,244 | 5/1987 | Wright | 194/317 |
| 4,819,780 | 4/1989 | Trummer et al. | 194/317 |
| 4,905,814 | 3/1990 | Parker et al. | 194/318 |
| 5,056,644 | 10/1991 | Parker | 194/318 |
| 5,085,309 | 2/1992 | Adamson et al. | 194/317 |

*Primary Examiner*—Margaret A. Focarino
*Assistant Examiner*—Scott L. Lowe
*Attorney, Agent, or Firm*—Eckert Seamans Cherin & Mellott

[57] ABSTRACT

A discriminator for coins and tokens monitors the extent to which an alternating electromagnetic field is coupled through a deposited coin and a reference coin, as the deposited coin passes along a feed path. A first electromagnetic field is incident on a reference coin along an axis normal to the reference coin and displaced from a midpoint of the reference coin. As the deposited coin moves through a second electromagnetic field traversing the feed path, the deposited coin passes two positions at which the second electromagnetic field is aligned to the deposited coin to a same degree as the first electromagnetic field is aligned to the reference coin. The electromagnetic fields preferably are provided by two series connected coils in a stack, and the fields passing through the coins are added at opposite polarity by a receiver coil placed between the series connected coils (and also between the sample coin and the deposited coin). The received signal is rectified, filtered and digitized, whereupon at least one of the following may be ascertained: the received waveform shape, the maximum and minimum peak levels, and the timing characteristics. This ascertained information, and detected data of an optical code on the deposited coin, can be compared to stored criteria, for passing or sorting coins.

20 Claims, 8 Drawing Sheets

COIN DISCRIMINATOR WITH OFFSET NULL COILS

BACKGROUND OF THE INVENTION

1. Field of the Invention

The invention relates to the field of methods and apparatus for determining the validity, denomination and/or similar attributes of conductive tokens such as coins, for operation of check controlled devices. The electromagnetic response of an input token is compared to the response of a reference token, using coils that are offset from a midpoint of the token. Optical means optionally read a code formed on the token, detection of the optical code being related to the timing of two instances when the electromagnetic response of the reference token and the checked token correspond if the checked token is the same as the reference token.

2. Prior Art

Coins and tokens are generally made in distinct sizes for different denominations, and can be sorted by size and/or weight. Coins may also be made in distinct materials or combinations of materials. It is known to discriminate among coins, tokens or the like fed into a coin-feed apparatus, based on the electromagnetic properties of the coins or tokens. Differences in the conductivity and magnetic permeability of different materials are sensed, for example, to determine if a coin is valid, or to trigger diverting means to assist in sorting coins of different denominations. For diverse coins made of the same material (e.g., silver or copper), the size of the coin also affects its electromagnetic properties, permitting discrimination among coins for denominations, for counterfeits, etc.

The apparatus may be responsive to the extent to which a coin passes or attenuates the energy of an incident alternating electromagnetic field, which is a function of the material and the dimensions of the coin. According to one form of coin discriminating apparatus, an alternating electromagnetic field is produced by applying a signal to a coil mounted adjacent the path of the coin, the coil forming part of a feedback oscillator. The effect of the coin on the inductance of the coil circuit can be measured to determine whether the properties of the coin fall within limits expected for a valid coin, for example by monitoring the frequency or phase shift produced. The coin can be examined for the extent to which a current induced in the coin by one coil is coupled, to an adjacent coil when the coin overlaps the two coils. According to a similar form of device, the extent to which a fed coin couples an incident alternating field from an exciter coil to a second, detection coil is used to discriminate among coins and materials. The coin can be examined for the extent to which the coin attenuates the strength of a field between the exciter coil and the detection coil. Examples of such devices are disclosed, for example, in U.S. Pat. Nos. 4,664,244—Wright; and 4,460,080—Howard. Slugs made of ferrous materials produce a strong response in such devices, but non-ferrous materials can also be discriminated, effectively sensing the conductivity and the dimensions of the coin material.

Both the material of the coin and its dimensions affect the electromagnetic properties of the coin. The speed of the coin in passing the discriminating apparatus may also be pertinent. Unscrupulous persons sometimes can defeat such discriminating apparatus, for example, by varying the dimensions and the materials of a slug until a response similar to that of a valid coin is obtained. A foreign coin that is close to the valid coin in size and material also may be substituted. The passage of the coin through the apparatus can be altered such as by slowly lowering the coin on a string until the desired extent of coupling is achieved between the coils (regardless of particular materials), and so forth. It may not be advisable to base discrimination solely on the response of a coin to a particular alternating field. The prior art has attempted various combination tests and other schemes to reduce the incidence of fraud. Such combination tests can involve alternating fields at a plurality of frequencies (U.S. Pat. No. 3,870,137— Fougere), tests of electromagnetic properties plus coin weight (U.S. Pat. No. 5,085,309—Adamson), etc., in addition to the traditional discrimination by coin size.

One objective of a coin discriminator is to detect small variations between coins, suggesting a need for close tolerances and narrow limits on the range of acceptable coin responses. However, it is also important to have a low rate of false rejections, i.e., rejection of coins that actually are valid coins. Variations in component values, particularly with temperature variation, can cause problems and may require regular calibration, or the inclusion of additional circuit complexity to account for such variations. Any additional expense, and potential requirements for the attention of service technicians due to these problems, are highly undesirable. The coin discriminating apparatus needs to be very inexpensive, durable and operationally effective over the long term without maintenance.

In U.S. Pat. No. 4,469,213—Nicholson et al, a coin discriminator is disclosed that is inexpensive and effective, and is substantially insensitive to component variations, because the mechanism compares the deposited coin's response to the response of a sample coin in a common mode rejection technique. A stack of three coils is provided, with the two outer coils excited by an alternating current having a range of frequency components. A sample coin of the desired denomination is held stationary between the center coil and one of the excited coils, and the deposited coin is dropped between the center coil and the other excited coil. As the deposited coin falls, it passes a point at which the deposited coin and the sample coin produce the same response with respect to the extent to which the outer coils are coupled (through the respective coins) to the middle coil. The respective coils are wired so that the energy from the two outer coils is coupled through the coins to the center coil at opposite polarity. As a result, the sum of the two signals applied to the center coil is reduced theoretically to zero when a deposited coin that is identical to the sample coin passes through the point at which the two coins precisely align in registry between the coils.

The signal from the middle coil is amplified and filtered. A null detector having an adjustable sensitivity (i.e., an adjustable low going threshold) detects the occurrence of the minimum or null. Associated timing circuits require that the null have a particular maximum and minimum duration in order to trigger the output, thus obviating most attempts to defeat the apparatus using a coin on a string. One benefit of using a comparison between the deposited coin and a sample coin is that the same device can be changed to test for a different coin denomination by changing to a new sample coin. However, the size of the coin affects that rate at which the coin falls through the device, and the rate of the fall affects the duration of the null. To accommodate coins of different sizes, Nicholson teaches a spring loaded pivoting coin ramp leading into the detection zone between the coils. A heavier coin moves the coin ramp to a steeper angle than a lighter coin. Thus, smaller coins pass more slowly than larger ones, and the duration of the null remains approximately the same. A slide arrangement is provided to position the coil stack and the sample coin where required to align with a deposited coin of the denomination to be checked. A solenoid-driven coin diverter is mounted downstream of the coil stack, and is triggered by the null detector to either pass or divert the deposited coin.

According to Nicholson, the axis of the coil stack is placed at the midpoint of the sample coin in the direction of coin travel. Only one null on the signal from the middle coil occurs during passage of the deposited coin, namely when the deposited coin and the sample coin are in registry with one another between the detector (middle) coil and the respective exciter (outer) coils.

The Nicholson device is advantageous in that it is durable and relatively simple. However, it relies heavily on the duration of the null that occurs at the point when the sample and deposited coin align, which is not completely effective. The person or mechanism depositing the coin may have some control over the rate at which the deposited coin passes the detection zone. The spring loaded coin ramp tends to slow operation. The ramp is a moving part whose operation may vary over time, and may require maintenance.

According to the present invention, it has been discovered that by placing the coil stack at a point that is offset from the midpoint of the coins along the feed direction, leading or trailing, it is possible to produce and examine two nulls occurring as the deposited coin passes the sample coin. One null may occur when the sample and deposited coins are in registry, as in Nicholson. Another null occurs when the two coins are symmetrically arranged relative to the offset coil axis. The character of the two nulls is distinct in certain test situations, such as when the sample coin and the deposited coin are of different materials and/or sizes. The spacing of the two nulls in time is a measure of the rate of fall of the coin, making a coin speed adjustment mechanism unnecessary. The signal is examined not only for the low-going threshold at the nulls, but also can be examined for the height of a peak occurring between the nulls. Preferably, the AC signal from the detection coil is rectified, filtered and digitized for processing via a microcomputer. An optical encoder can be associated with the device, for reading minted identification codes, provided on the coin at a predetermined point that can be windowed in time by the microprocessor, with reference to the signal level from the detection coil. The device is more accurate and less dependent on moving parts than the known, single-null device of Nicholson, and is very inexpensive to produce and to use.

SUMMARY OF THE INVENTION

It is an object of the invention to provide an improved coin and token discriminator for comparing a deposited coin to a sample coin held in the apparatus.

It is another object of the invention to provide a balanced coil coin/token comparator that produces a plurality of nulls or peaks as a deposited coin and a sample coin pass through stages of alignment.

More particularly, it is an object to mount a coin sensing means responsive to alignment between a reference or sample and a deposited coin such that the sensing means leads or trails the midpoint of the coin and the reference, thereby producing two nulls for examination, one occurring upon exact registration of the coin and the reference or sample and the other occurring when the reference and the sample are symmetrically arranged around an axis of the sensing means.

It is a further object of the invention to provide a coin sensing means that provides a signal pattern with reference points indicative of coin feeding speed, as well as additional signal aspects that can be compared to nominal parameters for discriminating between coins.

It is still another object to provide a coin sensing means producing a signal having timing aspects from which a window can be determined for valid reading of a code provided on the coin, such as a bar code defined by faces of circular ridges inclined at a distinct angle relative to the coin face, and/or a window for valid reading of a second null. In the event a window is defined for the second null, the slope of the signal can be used to estimate coin speed and the feed speed is then used to predict a timing window during which the second null should validly occur.

These and other objects are accomplished by a discriminator for coins and tokens that monitors the extent to which an alternating electromagnetic field is coupled through a deposited coin and a reference coin, as the deposited coin passes along a feed path. A first electromagnetic field is incident on a reference coin along an axis normal to a plane of the reference coin and displaced from a midpoint of the reference coin. As the deposited coin moves through a second electromagnetic field traversing the feed path, the deposited coin passes two positions at which the second electromagnetic field is aligned to the deposited coin to the same degree as the first electromagnetic field is aligned to the reference coin. The electromagnetic fields preferably are provided by two series connected coils in a stack, and the fields passing through the coins are added at opposite polarity by a receiver coil placed between the series connected coils (and also between the sample coin and the deposited coin). The received signal is rectified, filtered and preferably digitized, whereupon at least one of the received waveform shape, the maximum and minimum peak levels, timing characteristics, the detection of an optical code on the deposited coin and/or the data found on the optical code, can be compared to stored criteria for passing, sorting or counting coins and the like.

One oscillator can provide an alternating current in two identical series connected coils to provide the fields. A controller or processor coupled to a digitizer discriminates for attributes of the received signal, such as a level of the nulls or peaks, a waveform shape, timing between the nulls, the equality of the nulls as mirror images, etc. The optical code preferably is defined by annular rings on the deposited coin, having faces inclined at a predetermined angle, detected at a predetermined time referenced to the nulls, by a source and sensor optical pair aligned to the angle of the faces.

The waveforms can be analyzed in detail in the area of the nulls, providing good coin discrimination accuracy. Whereas two null points are obtained by the off center positioning of the field applied to the reference coin, rather than one, additional sensing information is obtained. For example, the signal level at the peak occurring between the nulls also can be monitored :for discriminating coins. The invention reduces the possibility of erroneous coin discrimination or defeat of the device by varying the coin feed speed, spurious coins are detected even when their characteristics are similar but not identical to real coins, such as in size or materials.

Additional objects and advantages will be apparent from the following discussion of particular examples and embodiments.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
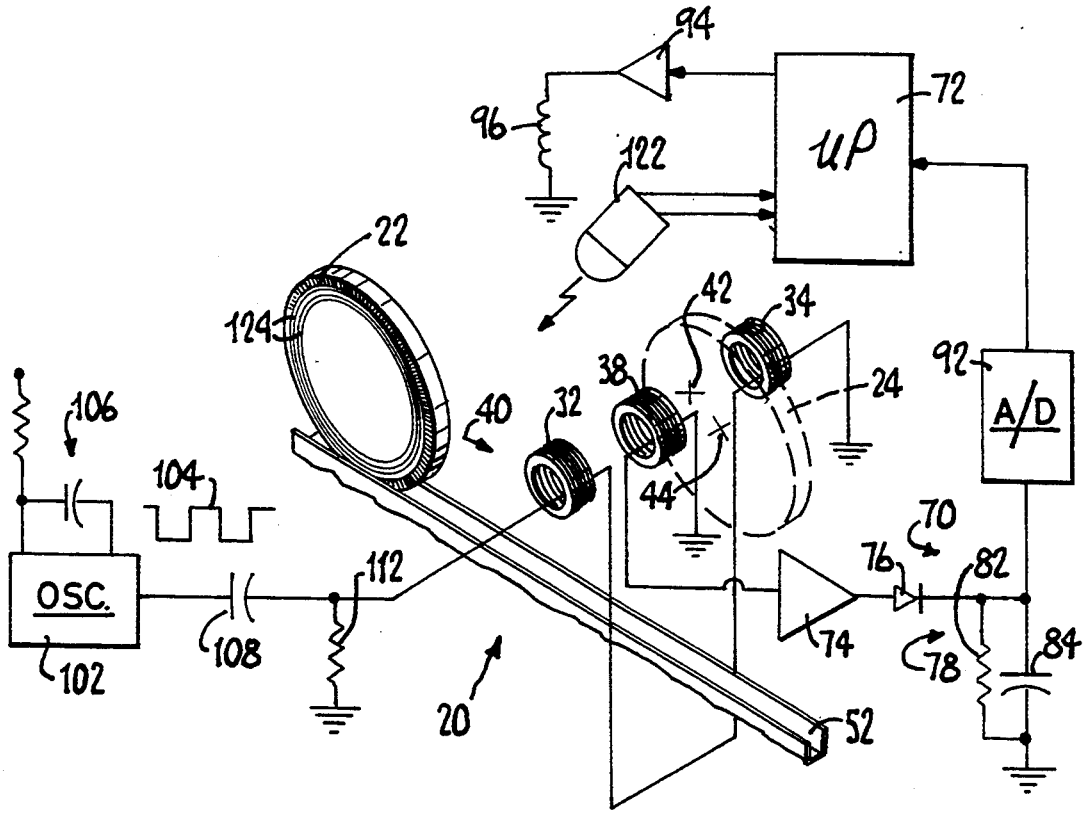
FIG. 1 is a partly schematic perspective view showing the basic operative elements of the invention.

FIG. 1 illustrates the operative arrangements and elements according to the invention. The invention provides a discriminator apparatus 20 for coins, tokens and similar items that typically represent value and are used to trigger the operation of controlled devices. Examples of such devices include gaming machines, vending machines, access control turnstiles and the like. The invention is applicable to specially issued tokens as well as to currency. However, for purposes of convenience, all such items will be referred to as coins.

The invention compares a deposited coin 22 to a reference coin 24 mounted in the apparatus 20. The reference coin 24 can be an actual coin of the type to be checked, or a body of material having characteristics resembling a valid coin. The discriminator 20 optionally can be associated with other means for sorting or discriminating among coins, such as mechanical sorters for size or weight, permanent magnets, etc. (not shown).

The invention is generally similar to the coin discriminator disclosed in U.S. Pat. No. 4,469,213—Nicholson et al., the disclosure of which is hereby incorporated. However, the invention has certain important differences. In general, a reference coin 24 is held in stationary position between an exciting or sending coil 34, powered by an alternating current with various frequency components, and a sensing or receiving coil 38. A deposited coin 22 moves along a feed path 40, passing between a second exciting coil 32 and the receiving coil 38. Each of the coins 22, 24 has an effect on the extent to which the electromagnetic field of the respective exciting coil 32, 34 is coupled to the receiving coil 38, due to the conductivity and magnetic permeability of the material of the coins, and their dimensions (thickness and diameter). The coin 22 or 24 typically attenuates the field due to energy dissipation in eddy currents in the conductive material of the coin. However, the coin may also improve the coupling of the respective send and receive coils, for example as in the case of a ferrous coin material that reduces the air gap of the magnetic circuit including the coils 32, 34, 38. The coils are arranged, however, such that the effect of the reference coin 24 and the effect of the deposited coin 22 are the same when the two coins reside at the same positions between their coils 32, 38 or 34, 38. Thus, variations in dimensions, conductivity, permeability and the like between the coins cause differences in coupling of the fields, permitting the coins to be discriminated automatically for deposited coins 22 that do not match the reference coin 24.

Coil 34 provides a first electromagnetic means that generates an AC field incident on the reference coin 24 along an axis 42 substantially normal to the plane of the reference coin 24. The field is coupled through the reference coin 24 to the receive coil 38. Coil 32 likewise provides a second electromagnetic means that generates an AC field coupled across the feed path 40 of the deposited coin 22 from coil 32 to the receive coil 38. The axis or centerline 46 of the field applied through the reference coin 24 is displaced from a midpoint 44 of the reference coin 24, intersecting the surface of the reference coin 24 at the point indicated by a cross in FIG. 1. A feed slot or track 52, shown schematically in FIG. 1, guides the movement of the deposited coin 22 along the feed path 40 such that the deposited coin 22 passes between send coil 32 and receive coil 38.

As shown in FIG. 1, the two send coils 32, 34 can be wired in series, thereby producing synchronous AC fields of the same polarity. The current induced in the receive coil 38 represents the sum of the effects of the two send coils 32, 34. However, the send coils 32, 34 couple to the receive coil 38 at opposite ends, i.e. at opposite polarities. Therefore, the current induced in the receive coil 38 represents the difference between the induced currents from the two send coils 32, 34. When the deposited coin 22 couples the field from send coil 32 to receive coil 38 to the same extent that the reference coin 24 couples the field from send coil 34 to the receive coil 38, the summed currents induced in the receive coil cancel one another and the output of the receive coil is zero, or null.

The field of coil 32, representing the electromagnetic field incident on the deposited coin 22, is also applied along an axis or center line substantially normal to the plane of deposited coin 22, and preferably the two send coils 32, 34 and the receive coil 38 are aligned on a common axis 42. As the deposited coin 22 advances along the feed path 40, it reaches a point at which the deposited coin 22 aligns with the reference coin 24. Provided the deposited coin 22 matches the reference coin 24, the fields coupled through the coins 22, 24 to the receiving coil 38 are then equal and opposite, and a null occurs in the current signal of the receive coil 38.

However, unlike the situation in U.S. Pat. No. 4,469,213—Nicholson et al., the fact that the center line of the field on the reference coin 24 is off center, i.e., displaced radially from the center 44 of the reference coin 24, causes the deposited coin 22 and the reference coin 24 to have the same relationship to their respective send coil 32 or 34 and the receive coil 38 at two positions of the deposited coin 22 along the feed path 40, instead of only one such position. Therefore, two nulls 62, 64 are produced as shown in the waveform plot of FIG. 4, and the nulls occur due to distinct relationships of the two coins 22, 24. The two nulls may produce different minimum induced current levels in the receive coil 38, and provide a further and more accurate means for distinguishing between deposited coins 22 that do or do not match the reference coin 24.

Figure 2:
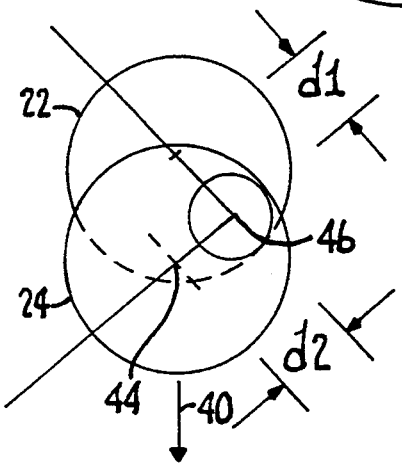
FIG. 2 is an elevation view showing the offset mounting of the coil axis relative to the reference coin.

In each case, the nulls occur when the field applied through the moving deposited coin 22 is spaced from the center of the deposited coin by the same distance that the field applied through the stationary reference coin 24 is spaced from its center 44. FIG. 2 demonstrates a first arrangement, wherein the coin feed path 40 carries the deposited coin 22 into registry or alignment with the reference coin 24. Thus one of the null positions at which the two coins 22, 24 are equally aligned relative to their coils 32 or 34 and 38 occurs when the two coins 22, 24 are in registry. The other of the null positions occurs when the coins 22, 24 are not in registry but the moving deposited coin 22 has advanced to where its coil axis is spaced from its coin center by the same distance $d_1$ as the distance $d_2$ by which the center 44 of the stationary reference coin 24 is displaced from its coil center 46. This point of offset null can lead or trail the point at which the deposited coin 22 and the reference coin 24 are in registry.

Figure 3:
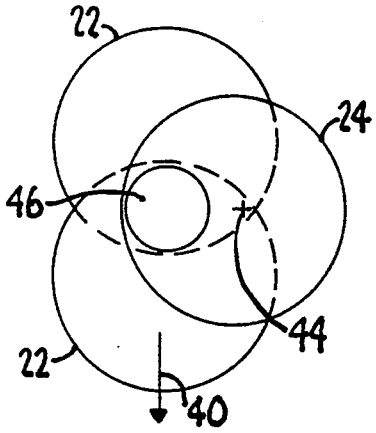
FIG. 3 is an elevation view showing an alternative configuration of the coil axis relative to the reference coin.

As shown in FIG. 3, two nulls can also occur where the deposited coin 22 and the reference coin 24 never come into registry, for example where the reference coin 24 is offset from a position parallel to the feed path 40. The two nulls occurring according to this embodiment are substantially identical, whereas in the embodiment according to FIG. 2, the two nulls may be affected by electromagnetic coupling between the coins 22, 24, which is unequal when the coins are in registry vs. out of registry, at least for some possible test situations (e.g., with ferrous coins or slugs).

In any event, a receiver circuit 70 is formed that is operable to compare responses of the deposited coin 22 and the reference coin 24 as the deposited coin 22 passes through said two positions, for comparing the deposited coin and the reference coin. According to the embodiment of FIG. 1, the receiver 70 includes the receiver coil 38, and means for encoding the current level in the receiver coil 38 for numerical analysis via a microprocessor 72. It would also be possible to use other means for discriminating for the two nulls, such as a timed analog circuit (not shown), operable to trigger an output when the sensor current passes a low current threshold close to zero.

The receiver coil 38 is coupled to the microprocessor 72 via an amplifier 74, a half wave rectifier diode 76 and a low pass filter 78 comprising resistor 82 and capacitor 84, for producing a waveform 90 including the nulls or peaks that result from summing the fields from coils 32, 34, coupled through the coins 22, 24 to the receiver coil 38. An analog to digital converter 92 converts the signal to a numerical code, and the output from the A to D converter 92 optionally can be scaled and/or offset in known manner. The microprocessor 72 compares successive samples to criteria stored in its memory, to reach a programmed decision of whether or not to operate an output means, shown generally as a driver 94 and solenoid coil 96 in FIG. 1, the solenoid either lifting or inserting a diverting or blocking means 98 into the feed path 40 of the deposited coin 22 at a point downstream of the coils 32, 34, 38.

The two illumination coils 32, 34 preferably are driven from the same oscillator 102. In the embodiment shown in FIG. 1, the oscillator 102 is a feedback oscillator producing a square wave 104 of a fixed frequency, defined by timing elements 106. The square wave output of the oscillator 102 is coupled to the coils 32, 34, which are connected in series, via a series capacitor 108 and parallel resistor 112, forming in general a differentiator or high pass filter. However, the two illumination coils 32, 34 form a tuned circuit with the capacitor 108, producing a ringing excitation voltage across the coils 32, 34, and providing a number of different frequency components. This is a simple method for providing a multiple frequency test, and it would also be possible to obtain multiple frequencies by other means, such as by repetitively switching among timing components coupled to the oscillator 102, providing a sawtooth input to a controlled oscillator to chirp the frequency of the output signal, etc.

Preferably, the two illumination coils 32, 34 are substantially identical, are wired in series, and are arranged to straddle the two coins 22, 24 around the receiver coil 38. It is also possible to arrange other specific means whereby fields coupled through a reference coin 24 and a deposited coin 22 are compared, for example involving more than one receiver coil 38 and coil arrangements wherein the coils for the reference coin and the deposited coin are physically displaced from one another. The center coil of a three coil stack also can be used as an exciter rather than a sensor, with the outer coils being the receivers. The embodiment shown, however, is preferred in that it is simple, inexpensive and compact.

The microprocessor 72 or other signal analysis means can test the receive coil current level for various attributes, a simple test being to check that two nulls 62, 64 occur and that both nulls cross a predetermined threshold (a minimum threshold in the embodiment shown). The processor 72 can also check other aspects of the waveform 90. The successive samples can be compared to a nominal waveform signature stored in memory, for checking rise and fall times adjacent a null 62 or 64. The duration of the null can be compared to nominal levels. The timing between the nulls and/or the central peak 115 can be assessed, and the null peaks 62, 64 can be compared as to whether they are mirror images in time. The level 115 to which the signal rises between the nulls 62, 64 can also be compared to a nominal standard stored in the memory of the microprocessor 72. The slope of the signal leading into the initial null can be measured to determine coin speed, and the speed can be used to define a window at which the second null should be expected in a valid coin. The coin speed likewise can be used to define a window during which a code on a valid coin should pass a sensing means.

With a series of tests being available in this manner, it is possible not only to discriminate valid coins of a particular denomination from slugs, foreign coins or the like, but also to determine with reasonable accuracy the type of certain invalid coins (e.g., their denominations). For example, a coin discriminator arranged to discriminate for quarters can determine from the character of the sensed waveform that a dollar coin has been fed, and react appropriately (e.g., interpret the dollar coin as the deposit of four quarters). Thus the invention is applicable to sorting coins as well as pass/fail testing.

Figure 4:
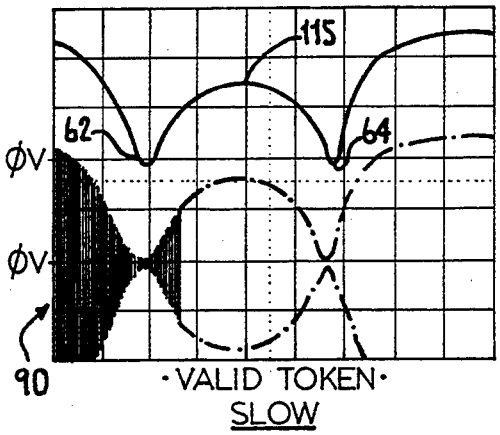
FIG. 4 is a time plot showing the receiver coil output signals during passage of a deposited coin, a valid coin having been fed at a relatively slow speed.
Figure 5:
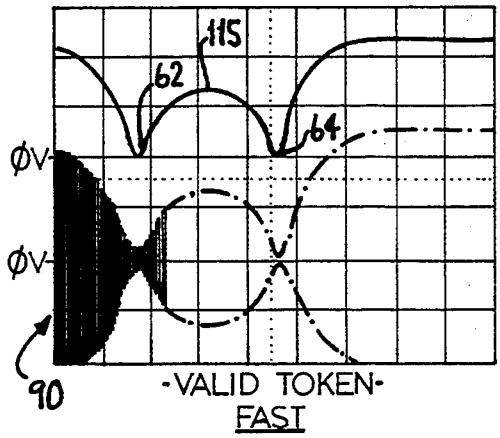
FIG. 5 is a corresponding time plot showing the valid coin fed at a faster speed.

Typical output signals or waveforms 90 as developed by the receiver coil 38, and as rectified and filtered, are shown in FIGS. 4–7. In FIGS. 4 and 5, the signals represent a deposited coin 22 that matches the reference coin 24, both comprising, for example, a silver alloy. In FIG. 4, the deposited coin 22 was fed more slowly than in FIG. 5. In each case, the rectified/filtered signal 90 is high prior to the arrival of the deposited coin 22, due to the unequal coupling of the two send coils 32, 34 to the receive coil 38 through only one coin (the reference coin 24). The signal drops to a first null 62 as the deposited coin arrives, having a fall time or waveform contour that partly represents the coin speed and partly represents the character of the deposited coin 22. Upon passing the null 62, at which the signal level is essentially zero, the signal rises to a peak 115 that is less than the empty level, then drops again to a second null level 64 substantially equal to the first. The microprocessor or controller 72 monitors successive samples of the signal level and reaches an accept/reject decision or operates a diverter or other output means, based on the waveform 90, and in particular by the observation of the two nulls 62, 64, the slope of the signal leading into or out of the null(s) and/or the reading of a code or other detectable feature at a known position on a valid coin.

The two nulls occur regardless of coin feed speed, as shown by a comparison of FIGS. 4 and 5. Coin feed speed variations can be accommodated in the discrimination process by relating together the time spacing, waveshape and/or duration of the nulls. For example, the expected duration of the nulls or the expected time spacing between the nulls can be determined in part from stored information relating to the character of the coins, and in part from the speed of the coin, determined from the slope of one or more edges leading into or out of the nulls. A wide range of speeds, such as might be encountered in a high speed sorting or counting machine, can be accommodated in this manner by calculating the separation of the nulls from information derived from the slope of the incoming waveform.

Figure 6:
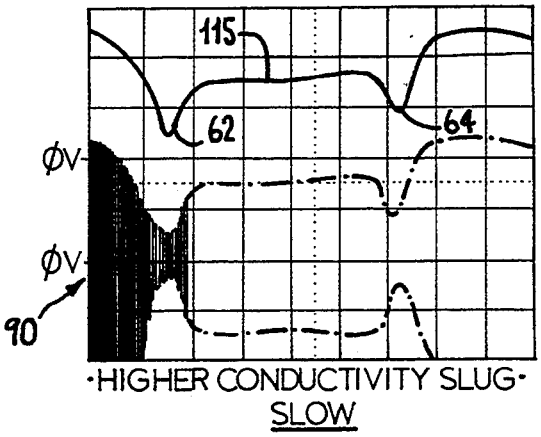
FIG. 6 is a time plot showing an invalid coin fed at a slow speed.
Figure 7:
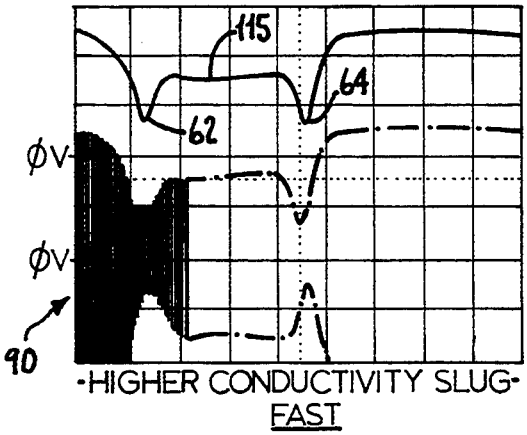
FIG. 7 is a time plot showing the invalid coin at a faster speed.
Figure 8:
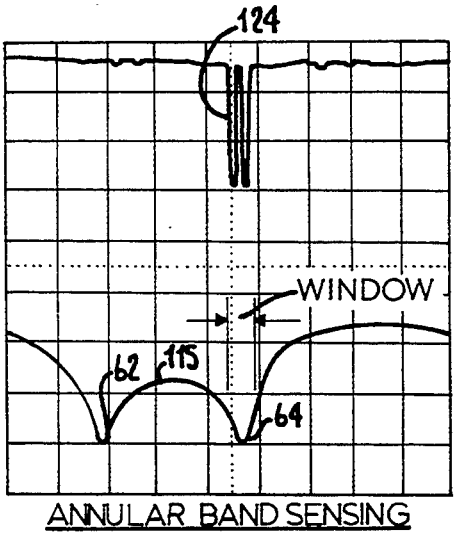
FIG. 8 is a time plot comparing the receiver signal with the output of an optical reader sensing an annular band code on the coin.

FIGS. 6 and 7 demonstrate corresponding waveforms where the deposited coin 22 does not match the reference coin 24. In the example shown, the deposited coin 22 is a brass slug and the reference coin 24 is a silver alloy coin. The brass slug has a higher conductivity than the silver alloy reference coin. One problem with discriminating for spurious coins by comparing fields coupled through the center of the coins is that attempts may be made to defeat a discriminating apparatus by varying the speed of the deposited coin. For example, assuming the material or dimensions of the spurious coin are such that the spurious coin attenuates the electromagnetic field less than does the reference coin, a sufficiently slow feed speed may cause the discriminator to react to a null occurring prior to the point at which the deposited coin aligns fully with its electromagnetic field and thus attenuates the field less. Conversely, if the spurious coin attenuates the field more than the reference, a sufficiently fast feed speed could pass the deposited coin before the circuitry (e.g., such as low pass filter 78) reacts completely. For example, the waveform for a deposited brass coin in FIG. 6 has an initial minimum 62 that is nearly zero. FIG. 7 shows the waveform where the brass coin was fed at a faster speed, and both nulls 62, 64 failed to approach zero.

According to the invention, two nulls are required 62, 64. One can occur with alignment of the coins in registry, and the other with symmetrical positioning of the coins to the axes of their respective fields. As a result, one or more of the respective levels of the two nulls, their timing and wave shape can be compared to nominal parameters for discriminating good coins from spurious ones. The nominal parameters for particular coins can be determined empirically and programmed into the microprocessor, calculated from the known geometry of the coils and the reference coins, and the maximum and minimum feeding speeds of the deposited coins.

Even if a null 62 nearly reaches zero as in FIG. 6, the second null 64 may not fall as low, or may occur at a different point in time (e.g., later) than nominally expected in view of geometry and feed speeds. The levels, timing and/or the inequality of the two nulls 62, 64 may be used to trigger a reject decision.

According to one aspect of the invention, a further means for relating the position of the nulls 62, 64 (in time) to the physical position of the deposited coin 22 between the coils 32, 38 can further ensure that the coin discriminator apparatus 20 cannot be fooled by spurious coins. For this purpose, the position of the deposited coin 22 can be detected optically. As shown in FIG. 1, a light source and optical receiver element 122 is directed at the deposited coin feed path 40. The optical receiver 122 is coupled to the microprocessor 72 for detecting and signalling the time at which the deposited coin 22 reaches a known position, which can be related in time to the nominal or expected occurrence of one or both nulls 62, 64. Preferably, the source/receiver device 122 is inclined at a predetermined angle relative to the plane or face of the deposited coin 22. The deposited coin 22 has one or more correspondingly inclined annular ridges 124. When a ridge 124 reaches the position needed, in view of its angle, to reflect light from the source to the optical receiver 122, the microprocessor 72 is signalled by the output of the optical receiver. The microprocessor 72 can then relate the time position of the nulls 62 and/or 64 to the detected position of the deposited coin 22.

The microprocessor also can monitor for a detectable feature at a known position on a valid coin. A plurality of annular ridges representing a code can be provided on valid coins, for example as in U.S. Pat. No. 5,216,234—Bell, which is hereby incorporated. By reading the code from a surface of the deposited coin 22, and discriminating for said reading to occur at a predetermined point between the null peaks 62, 64, the validity of the deposited coin 22 is examined in a plurality of ways to reduce the possibility of missed discrimination, counterfeiting and the like.

Figure 9:
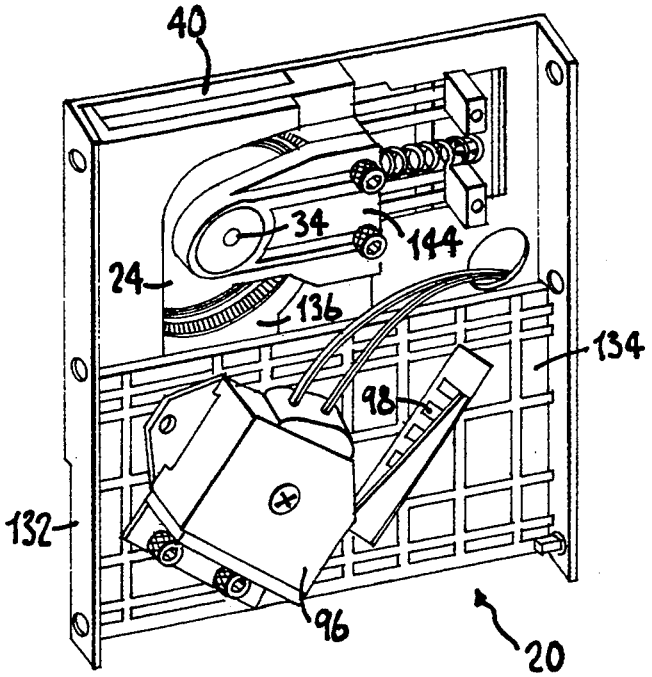
FIG. 9 is a perspective view showing a preferred modular embodiment of the invention in a coin discriminator unit.
Figure 10:
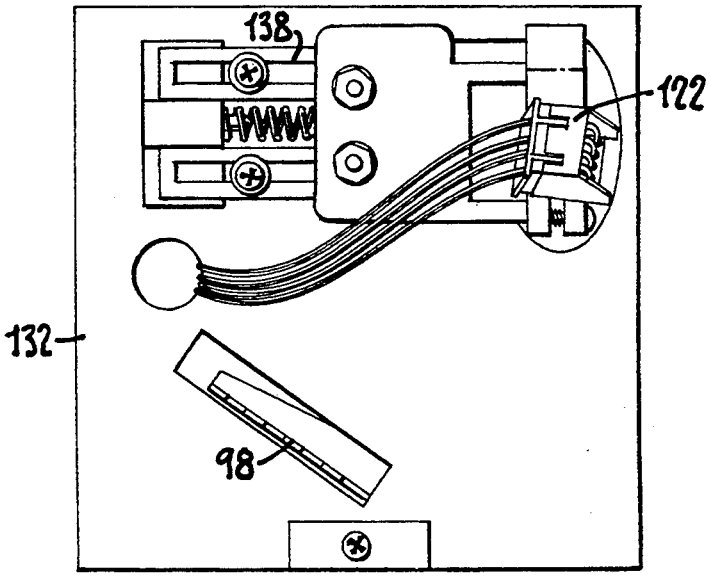
FIG. 10 is an elevation view showing the back side of the coin discriminator unit as compared to FIG. 9.
Figure 11:
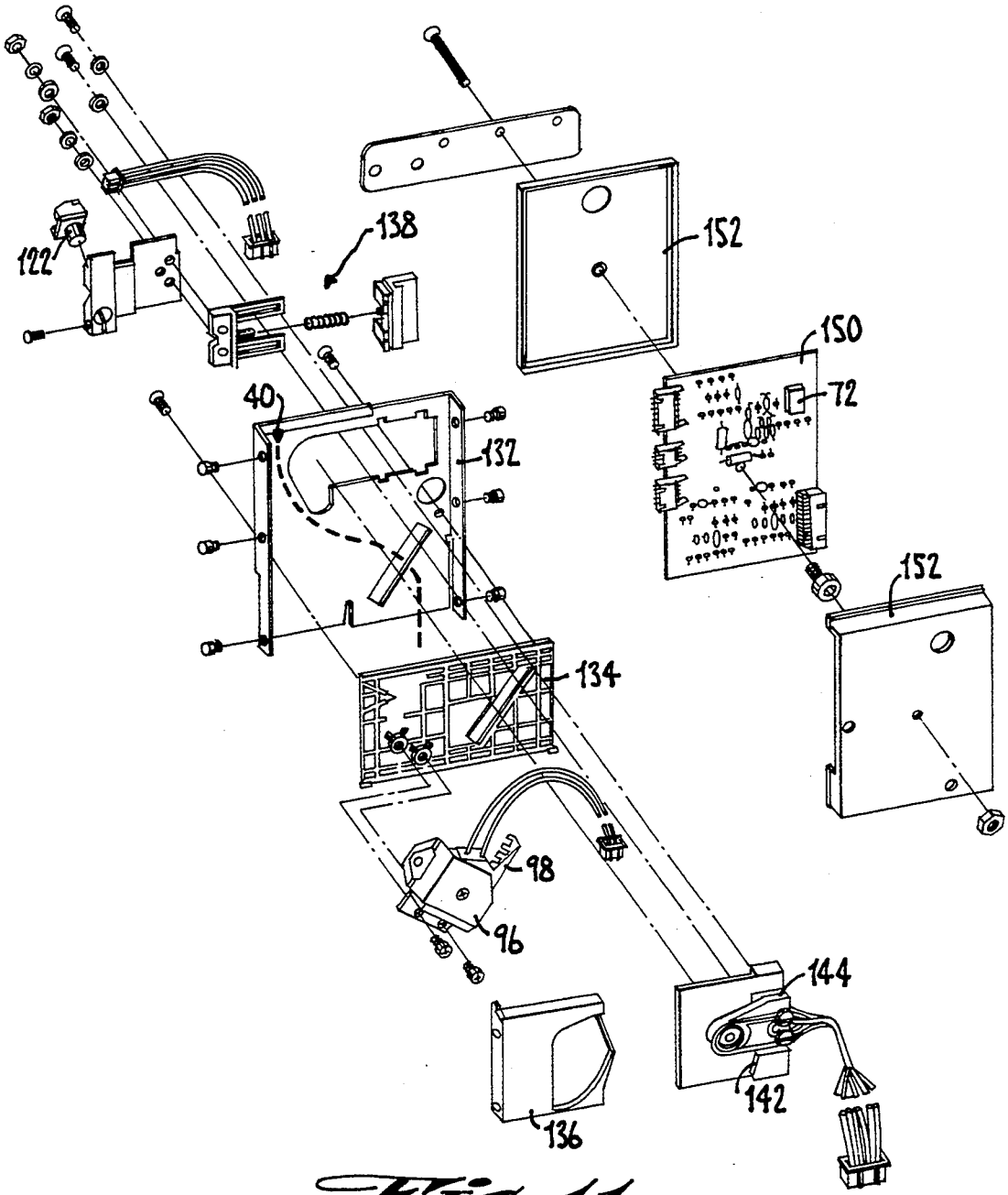
FIG. 11 is an exploded perspective view showing the coin discriminator parts and mountings, and including a depiction of the associated circuitry.
Figure 12A:
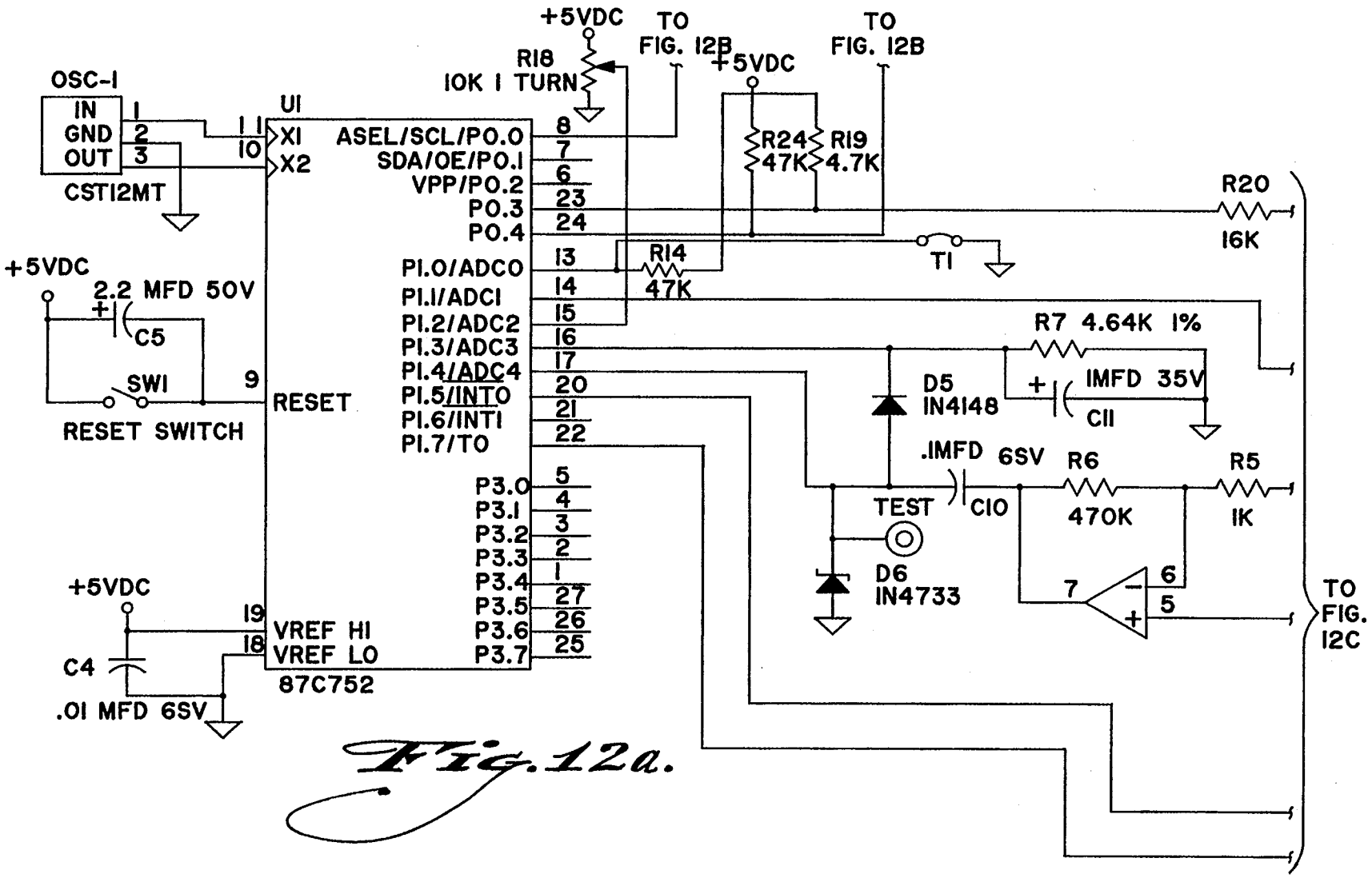
FIGS. 12(*a*) through 12(*d*) are matched parts of a detailed schematic showing a practical embodiment of the circuitry employed according to the invention (collectively herein "FIG. 12").
Figure 12B:
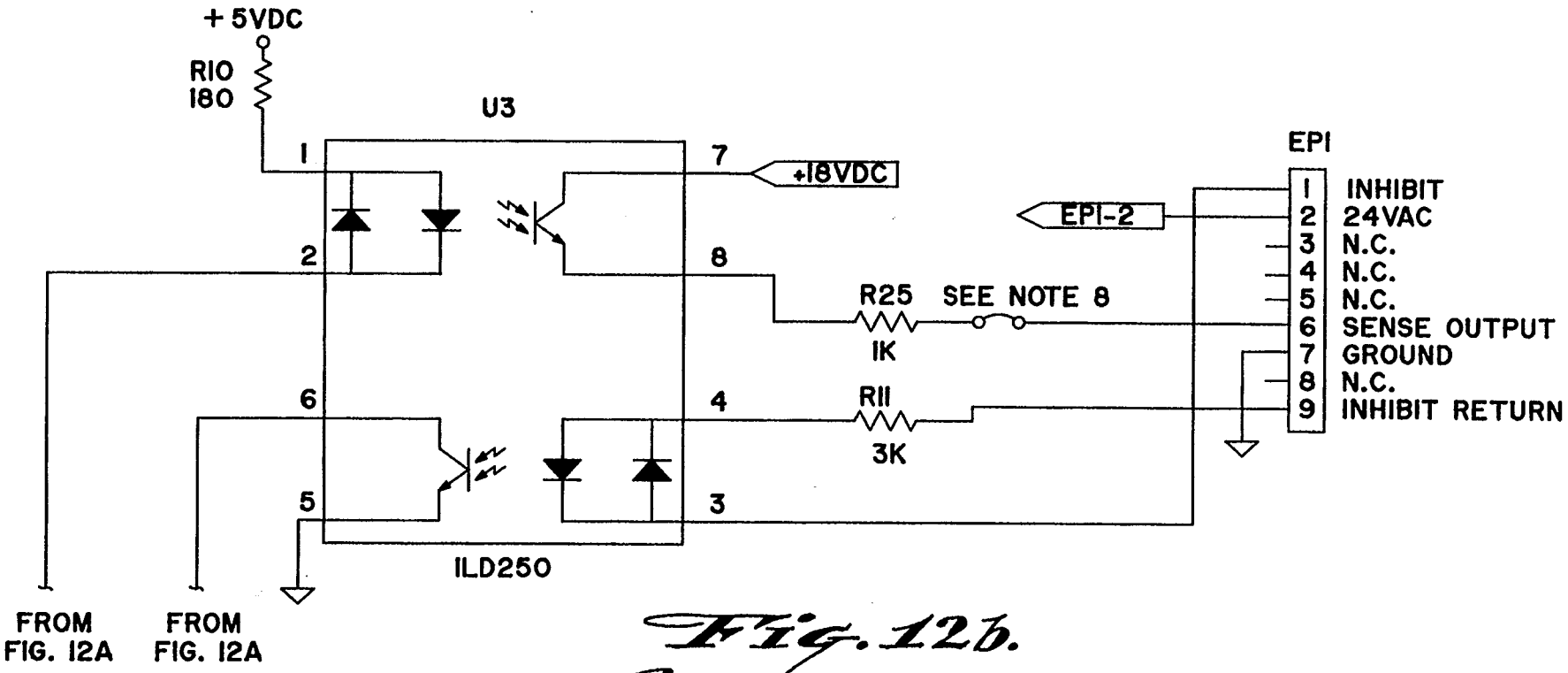
Figure 12C:
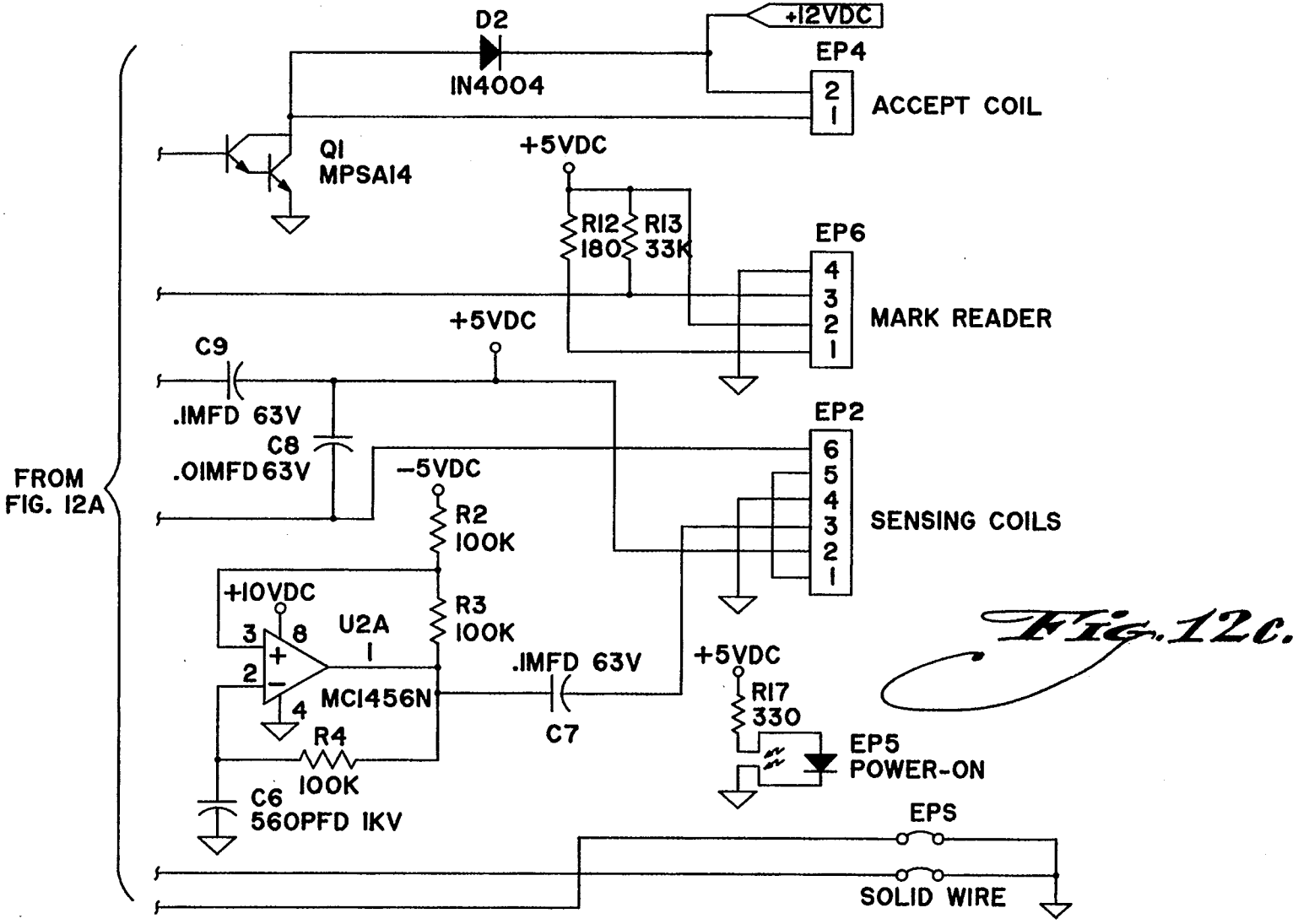
Figure 12D:
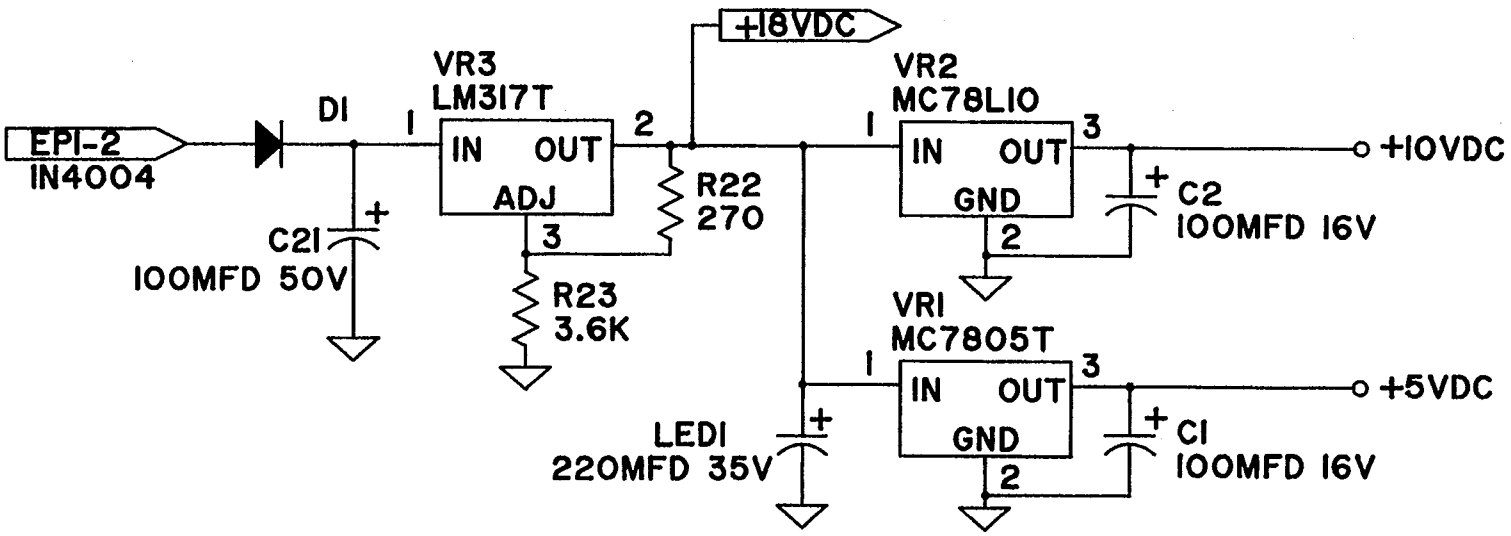

FIGS. 9–11 show a physical embodiment of the coin discriminator 20 according to the invention, which is modular in nature and can be retrofitted to various coin feed apparatus. The coin feed path 40 is generally vertical as shown, and defined between portions of a chassis 132 and an assembly of formed plastic elements 134 defining a slot 52 with chassis 132. The reference coin 24 is received in a carrier 136 (FIG. 9) that is urged by a spring biased slide mounting 138 (FIG. 10) toward a stop 142 such that the position of the reference coin 24 is positively determined. The three coils 32, 34, 38 can be mounted on a fitting 144 having three spaced leg portions for the respective coils, the stop 142 being defined by the bottom of the fitting 144 between the inner leg and one of the outer legs, and the coin feed path 40 being arranged such that the deposited coin 22 falls along a surface corresponding to the stop 142, between the middle leg and the other of the outer legs. As shown in FIG. 10, the optical source/receiver pair 122 is preferably mounted to illuminate and view the deposited coin 22 through an opening in the chassis 132, and can be mounted on the same structure that urges the reference coin 24 toward the position defined by the stop 142. Thus, the reference coin 24, deposited coin 22 and optical source/receiver 122 are all disposed in the required relative positions whereby the axes of the electromagnetic fields are displaced from the center of the reference coin 24 and passed by the deposited coin 22 to develop two null positions as discussed above. Below the coil mountings along the path of the deposited coin, a controllable diverter 96 is arranged to either lift or insert a diverting paddle 98 from the coin feed path 40. The controllable diverter comprises a solenoid responsive to the means for detecting and discriminating for valid coins, i.e., the microprocessor 72 or other means that senses passage of the null peaks 62, 64 through a predetermined low threshold level.

FIG. 11 shows the individual parts of the assembly in an exploded view, together with the fasteners for attaching the parts to the chassis 132. The circuitry 150 can be mounted in an enclosure 152 attached to the chassis 132 or mounted nearby.

Accordingly, the invention is automatically operable for discriminating among coins and tokens deposited in the coin discriminator 20, especially to detect and react to whether or not a deposited coin 22 is of a same character as the reference coin 24. This is accomplished by applying a first alternating electromagnetic field to the reference coin 24, on an axis normal to a plane of the reference coin 24 and displaced by a predetermined distance from a midpoint of the reference coin 24, such that the first electromagnetic field is coupled through the reference coin 24 to an extent that is determined by a material and dimension of the reference coin 24; applying a second alternating electromagnetic field to a feed path 40 for the deposited coin 22, and allowing the deposited coin to move along the feed path such that the second electromagnetic field is coupled to the deposited coin 22 to an extent that is determined by a material and dimension of the deposited coin, and by a relative position of the deposited coin 22 to the second electromagnetic field. The deposited coin passes through two points at which the second electromagnetic field is displaced from a midpoint of the deposited coin by a distance equal to the predetermined distance by which the first electromagnetic field is displaced from the midpoint of the reference coin. At these points, the reference coin 24 and the deposited coin 22 have comparable effects on the first and second electromagnetic fields if the material and dimensions of the deposited coin and the reference coin are the same. By comparing the effects on the first and second electromagnetic fields as the deposited coin passes the two points, the invention discriminates for valid coins as a function of the result of such comparing.

The strengths of the first and second electromagnetic fields as coupled through the reference coin and the deposited coin, respectively, are detected and subtracted from one another. At a minimum, the sum is tested for the two null points 62, 64, and preferably the sum is tested for various waveform features characteristic of a deposited coin that is identical to the reference coin in dimensions and material. For additional certainty, the physical position of the deposited coin 22 is examined, for example using an optical detector 122, and the timing of the occurrence of one or both nulls is compared to the detected physical position to determine if the null(s) occurred earlier or later than nominally expected. Preferably, the optical detection includes reading a code from the deposited coin and comparing a time of reading to a window defined between the two points for discriminating for deposited coins 22 having the code 124 at a predetermined position. This code can also represent an indication of identity of the deposited coin, such as its denomination or the like. The identity code can form a means for the microprocessor 72 to determine the appropriate nominal characteristics by which the null points are examined or other criteria for acceptance, rejection or sorting of deposited coins.

FIG. 12 shows a practical embodiment of the circuitry used according to an exemplary arrangement of the invention, including component types and pin numbers. In this embodiment, amplifier U2A is arranged as a tuned feedback amplifier via resistor R4 and capacitor C6. Amplifier U2A produces a coil excitation signal that is AC coupled through a connector EP2 to the send coils (not shown in FIG. 12) via capacitor C7. The received signal from the sense coil is amplified by amplifier U2B and AC coupled via capacitor C10 and rectifier diode D5 to an analog input of controller U1. The signal is also low pass filtered by capacitor C11 and resistor R7. Controller U1 can be an 87C752 controller having on board A to D converters, and another analog input is coupled to the photodetector signal of an LED/photodetector pair (not shown in FIG. 12) via connector EP6.

The accept/reject signal reached by controller U1 is coupled to the coil of a solenoid diverter via connector EP4 and Darlington transistor Q1. Controller U1 can also communicate externally via an optical isolator U3, and in the embodiment shown in FIG. 12 is arranged to receive an inhibit/enable signal and to send a sense signal. Regulators VR1–VR3 provide the respective power supply voltages from an input voltage obtained via connector EP1-2; rectifier diode D1 and filter capacitor C21. A sensitivity adjustment R18 can be coupled to another of the inputs of controller U1, and inputs for a clock oscillator OSC-1, reset switch SW 1 and voltage reference are provided. A number of resistors and the like are shown in FIG. 12 for biasing, series coupling and the like, and need not be described in detail.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A discriminator apparatus for coins and tokens, comprising:

first electromagnetic means providing a field incident on a reference coin along an axis substantially normal to the reference coin, said axis being displaced from a midpoint of the reference coin;

means defining a feed path for guiding movement of a deposited coin;

second electromagnetic means providing a field incident on the deposited coin along an axis substantially normal to the deposited coin at a point along the feed path passed by the deposited coin, the deposited coin moving through two positions along the feed path at which the second electromagnetic means is aligned relative to the deposited coin to a same degree as the first electromagnetic means is aligned to the reference coin; and, a receiver operable to compare responses of the deposited coin and the reference coin as the deposited coin passes through said two positions, for comparing the deposited coin and the reference coin.

2. The apparatus according to claim 1, comprising at least one exciter coil and at least one receiver coil, and wherein the first and second electromagnetic means comprise at least one oscillator providing an alternating current in the exciter coil, the reference coin being fixed adjacent the exciter coil and the deposited coin passing along the feed path adjacent to the exciter coil such that the fields of the first and second electromagnetic means are coupled through the reference coin and the deposited coin, and wherein said receiver is coupled to the at least one receiver coil and is operable to compare electromagnetic signals applied by the exciter coil to the deposited coin and the reference coin, respectively.

3. The apparatus according to claim 2, comprising two substantially identical coils wired in series, and a third coil disposed between said two coils, one of the third coil and the two coils wired in series forming the exciter coil and the other forming the receiver coil, the reference coin and the feed path respectively being arranged between the third coil and one of said coils wired in series, wherein the electromagnetic signals coupled between the third coil and said two coils wired in series are at opposite polarity and are summed by the receiver coil, producing two null peaks in a current signal provided by the receiver coil when the deposited coin and the reference coin equally couple the electromagnetic signals of the exciter coil through the deposited coin and the reference coin to the receiver coil, as the deposited coin passes said point along the feed path.

4. The apparatus according to claim 3, wherein the receiver further comprises a rectifier and low pass filter, and means operable to detect passage of the null peaks through a predetermined threshold level.

5. The apparatus according to claim 4, further comprising a controllable diverter responsive to said means operable to detect passage of the null peaks through the predetermined threshold level.

6. The apparatus according to claim 5, further comprising means associated with the receiver for reading a code from a surface of the deposited coin, and discriminating for said reading to occur at a predetermined point between the null peaks, said controllable diverter also being responsive to said means for reading the code.

7. The apparatus according to claim 3, wherein the receiver further comprises a filter and a digitizer, operable to encode a level of the current signal provided by the receiver coil, and a processor coupled to the digitizer discriminating for at least one of a level of the null peaks, a waveform of the null peaks, timing between the null peaks, and equality of the null peaks as mirror images.

8. The apparatus according to claim 7, wherein the processor includes a memory and is operable to compare time samples of the current signal to nominal levels encoded by the memory, for discriminating the waveform of the null peaks.

9. The apparatus according to claim 7, further comprising means associated with the receiver for reading a code from a surface of the deposited coin, and discriminating for said reading to occur at a predetermined point between the null peaks.

10. The apparatus according to claim 9, wherein the code comprises a plurality of annular rings on the deposited coin, having faces inclined at a predetermined angle, and wherein the means associated with the receiver for reading the code includes a source and sensor pair aligned to said predetermined angle.

11. A method for automatically discriminating among coins and tokens deposited in a coin discriminator, for a deposited coin of a same character as a reference coin, comprising the steps of:

applying a first alternating electromagnetic field to the reference coin, the field having an axis that is normal to a plane of the reference coin and displaced by a predetermined distance from a midpoint of the reference coin, such that the first electromagnetic field is coupled through the reference coin to an extent that is determined by a material and dimension of the reference coin;

applying a second alternating electromagnetic field to a feed path for the deposited coin, and allowing the deposited coin to move along the feed path such that the second electromagnetic field is coupled to the deposited coin to an extent that is determined by a material and dimension of the deposited coin, and by a relative position of the deposited coin to the second electromagnetic field, the deposited coin passing through two points at which the second electromagnetic field is displaced from a midpoint of the deposited coin by a distance equal to the predetermined distance by which the first electromagnetic field is displaced from the midpoint of the reference coin, the reference coin and the deposited coin having comparable effects on the first and second electromagnetic fields at said two points, provided the material and dimensions of the deposited coin and the reference coin are the same;

comparing the effects on the first and second electromagnetic fields as the deposited coin passes the two points and discriminating for valid coins by a result of said comparing.

12. The method according to claim 11, further comprising reading a code from the deposited coin and comparing a time of said reading to a window defined between the two points for discriminating for deposited coins having the code at a predetermined position.

13. The method according to claim 11, comprising detecting strengths of the first and second electromagnetic fields as coupled through the reference coin and the deposited coin, respectively, and subtracting the strengths from one another to provide a sum, and wherein said comparing step includes testing the sum for two null points occurring as the deposited coin passes said two points.

14. The method according to claim 13, further comprising testing the sum for a predetermined waveform characteristic of a deposited coin that is identical to the reference coin in dimensions and material.

15. The method according to claim 13, comprising testing the sum for a minimum level at the two null points.

16. The method according to claim 13, comprising testing the sum for a maximum level between the two null points.

17. The method according to claim 13, comprising testing the sum for at least one time duration defined by variation of the sum.

18. The method according to claim 17, wherein the duration is chosen from the group consisting of pulse width adjacent one of the nulls, duration between the nulls, and rise and fall times.

19. The method according to claim 18, wherein a feed speed of the deposited coin is variable, and further comprising adjusting said duration to account for the feed speed.

20. The method according to claim 19, comprising measuring at least one slope of variation of the sum to determine said feed speed and using the feed speed as thereby determined to predict a valid timing window for at least one of occurrence of the second of said two nulls and a reading of a code on the deposited coin.

* * * * *